US011986108B1

(12) United States Patent
Rixter

(10) Patent No.: US 11,986,108 B1
(45) Date of Patent: May 21, 2024

(54) DRINKING VESSEL WITH MULTIPLE COMPARTMENTS

(71) Applicant: Jerry Rixter, Sachse, TX (US)

(72) Inventor: Jerry Rixter, Sachse, TX (US)

( * ) Notice: Subject to any disclaimer, the term of this patent is extended or adjusted under 35 U.S.C. 154(b) by 0 days.

(21) Appl. No.: 17/993,503

(22) Filed: Nov. 23, 2022

(51) Int. Cl.

| | |
|---|---|
| ***A47G 19/22*** | (2006.01) |
| ***B65D 25/04*** | (2006.01) |
| ***B65D 45/32*** | (2006.01) |
| ***B65D 47/30*** | (2006.01) |
| ***B65D 51/18*** | (2006.01) |
| ***B65D 81/38*** | (2006.01) |

(52) U.S. Cl.
CPC ..... *A47G 19/2272* (2013.01); *A47G 19/2288* (2013.01); *B65D 25/04* (2013.01); *B65D 45/325* (2013.01); *B65D 47/305* (2013.01); *B65D 51/18* (2013.01); *B65D 81/3865* (2013.01); *B65D 81/3869* (2013.01); *B65D 2251/0018* (2013.01); *B65D 2251/0078* (2013.01)

(58) Field of Classification Search
CPC ..... B65D 25/04; B65D 51/18; B65D 1/04; B65D 47/265; B65D 2251/0018; B65D 2251/0078; A47G 2019/122; A47G 19/2272; A61J 9/00
USPC ..... 220/553
See application file for complete search history.

(56) References Cited

U.S. PATENT DOCUMENTS

| | | | | |
|---|---|---|---|---|
| 311,415 | A * | 1/1885 | Cleveland | B65D 25/04 220/253 |
| 2,655,288 | A * | 10/1953 | Caretto | A47G 19/24 222/548 |
| 2,953,242 | A * | 9/1960 | Kinney | A61J 7/04 206/533 |
| 4,288,006 | A * | 9/1981 | Clover, Jr. | B65D 47/265 222/42 |
| 6,497,344 | B1 | 12/2002 | Dial | |
| 8,439,228 | B1 | 5/2013 | Graham | |
| 8,616,390 | B2 | 12/2013 | Kountotsis | |
| 8,746,475 | B2 | 6/2014 | Koumtotsis | |
| 2012/0199546 | A1 | 8/2012 | Dieni | |
| 2013/0153085 | A1 | 6/2013 | Sheller | |
| 2016/0123786 | A1* | 5/2016 | Hanna | B65D 51/18 220/254.2 |
| 2017/0000295 | A1* | 1/2017 | Hanna | A47J 47/04 |

FOREIGN PATENT DOCUMENTS

| | | |
|---|---|---|
| WO | WO2008110638 | 9/2008 |

* cited by examiner

*Primary Examiner* — Nathan J Jenness
*Assistant Examiner* — Jennifer Castriotta

(57) ABSTRACT

A drinking vessel assembly for containing multiple fluids includes a container with a plurality of discrete compartments for containing one or more fluids. Each of a plurality of caps covers one of the compartments. A lid has is rotatably coupled to the container and has an opening that is positionable in each of a plurality of selection positions such that the opening exposes a selected one of the caps. A locking assembly engages the lid and the container to secure the lid in one of the selection positions.

16 Claims, 7 Drawing Sheets

DRINKING VESSEL WITH MULTIPLE COMPARTMENTS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to drinking vessels and more particularly pertains to a new drinking vessel for discretely containing multiple fluids.

(2) Description of Related Art Including Information Disclosed Under 37 CFR 1.97 and 1.98

The prior art relates to drinking vessels including vessels that have multiple separate chambers and a rotating lid for selectively dispensing a fluid from a selected one of the chambers.

(h) BRIEF SUMMARY OF THE INVENTION

An embodiment of the disclosure meets the needs presented above by generally comprising a container with a base wall, a top wall, and a sidewall which coupled to and extends between the base wall and the top wall. The container includes a plurality of divider walls, each of which is coupled to and extends between the base wall and the top wall. Each of the plurality of divider walls is coupled to and extends inwardly from the sidewall, terminating in a junction of the plurality of divider walls. The plurality of divider walls form a plurality of compartments in the container, each of which is discrete from each other and each is configured for containing a fluid. The top wall has a plurality of top holes extending therethrough. Each compartment is in fluid communication with one of the top holes.

A plurality of caps each is coupled to the container, and each of the compartments has a top end that is closed by one of the caps. A lid is rotatably coupled to the top wall of the container. The lid has an opening extending vertically through the lid. The lid is positionable in each of a plurality of selection positions such that the opening is positioned over a selected one of the plurality of caps and the lid covers all except the selected one of the plurality of caps. A locking assembly is coupled to the container for securing the lid in one of the plurality of selection positions. The locking assembly engages the lid to urge the lid toward one of the plurality of selection positions.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
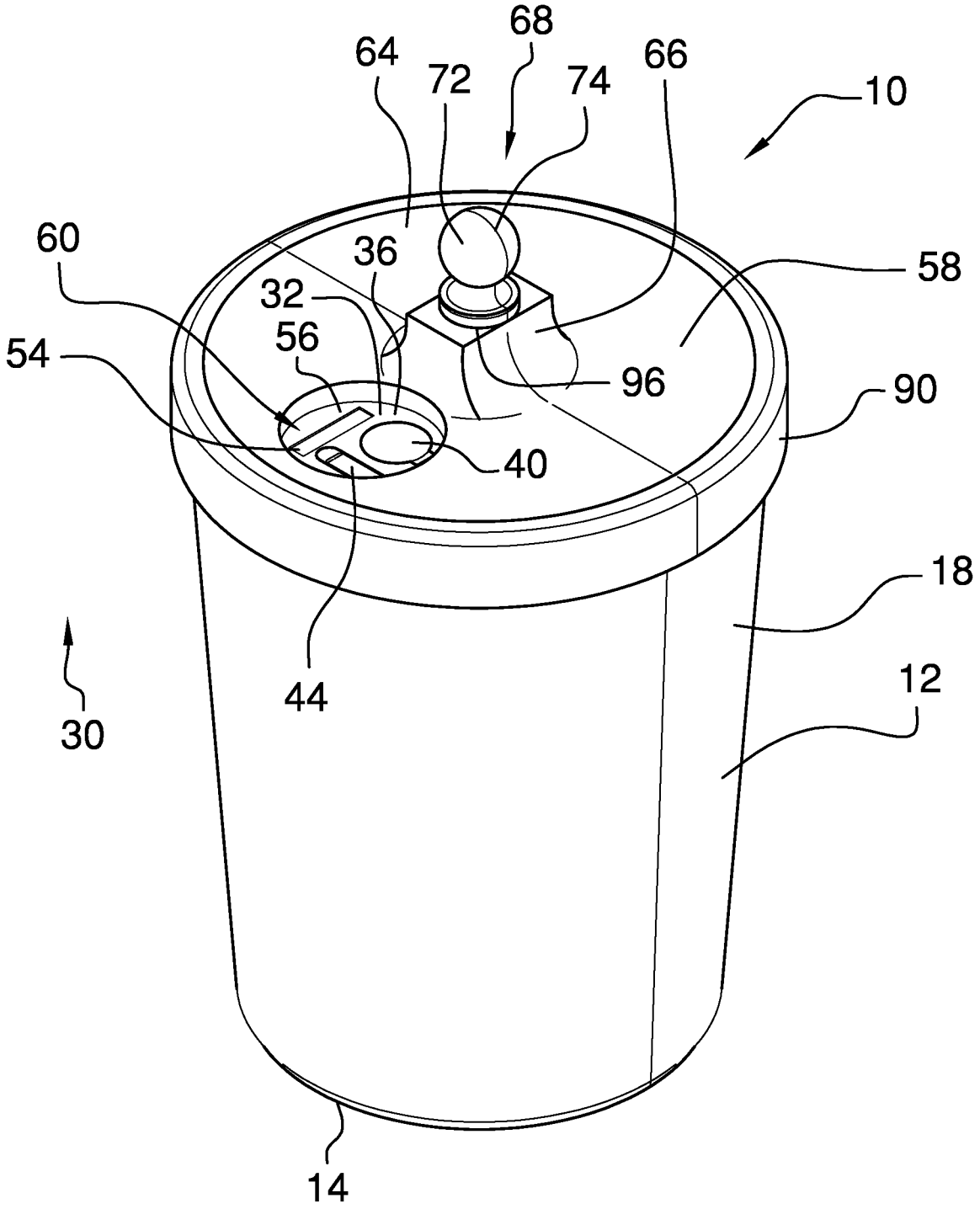
FIG. 1 is a top front perspective view of a drinking vessel assembly according to an embodiment of the disclosure.
Figure 2:
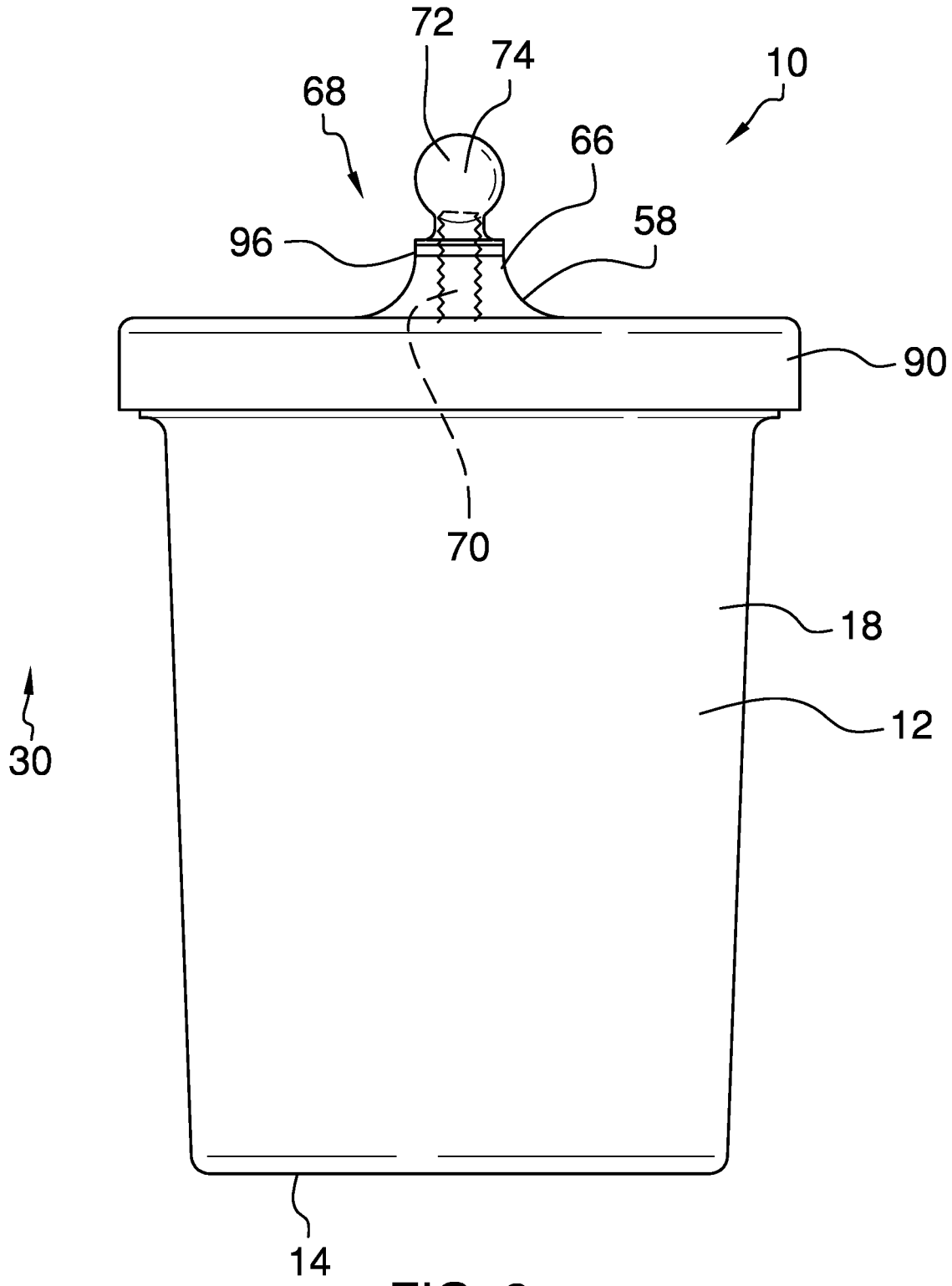
FIG. 2 is a front view of an embodiment of the disclosure.
Figure 3:
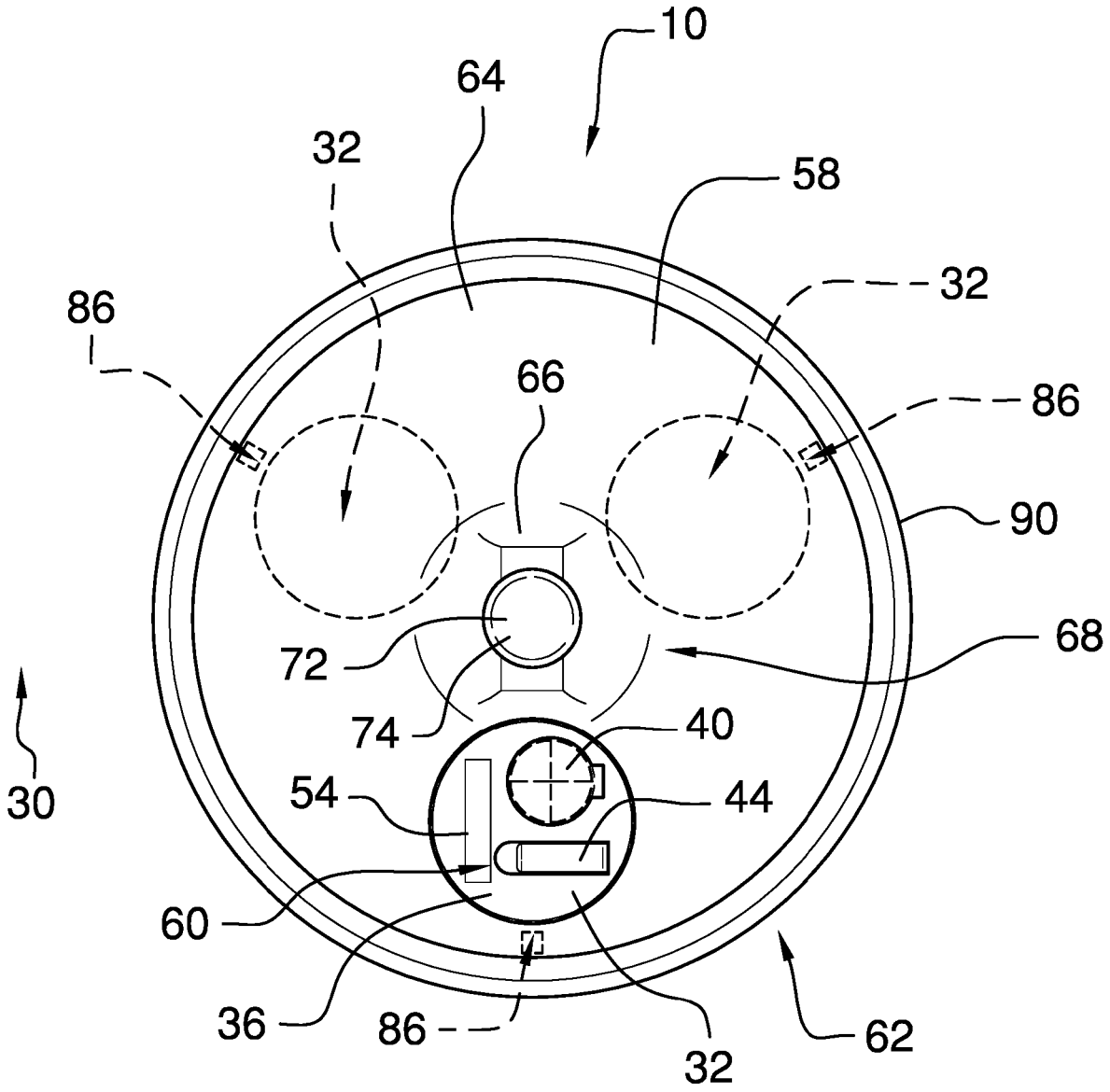
FIG. 3 is a top view of an embodiment of the disclosure.
Figure 4:
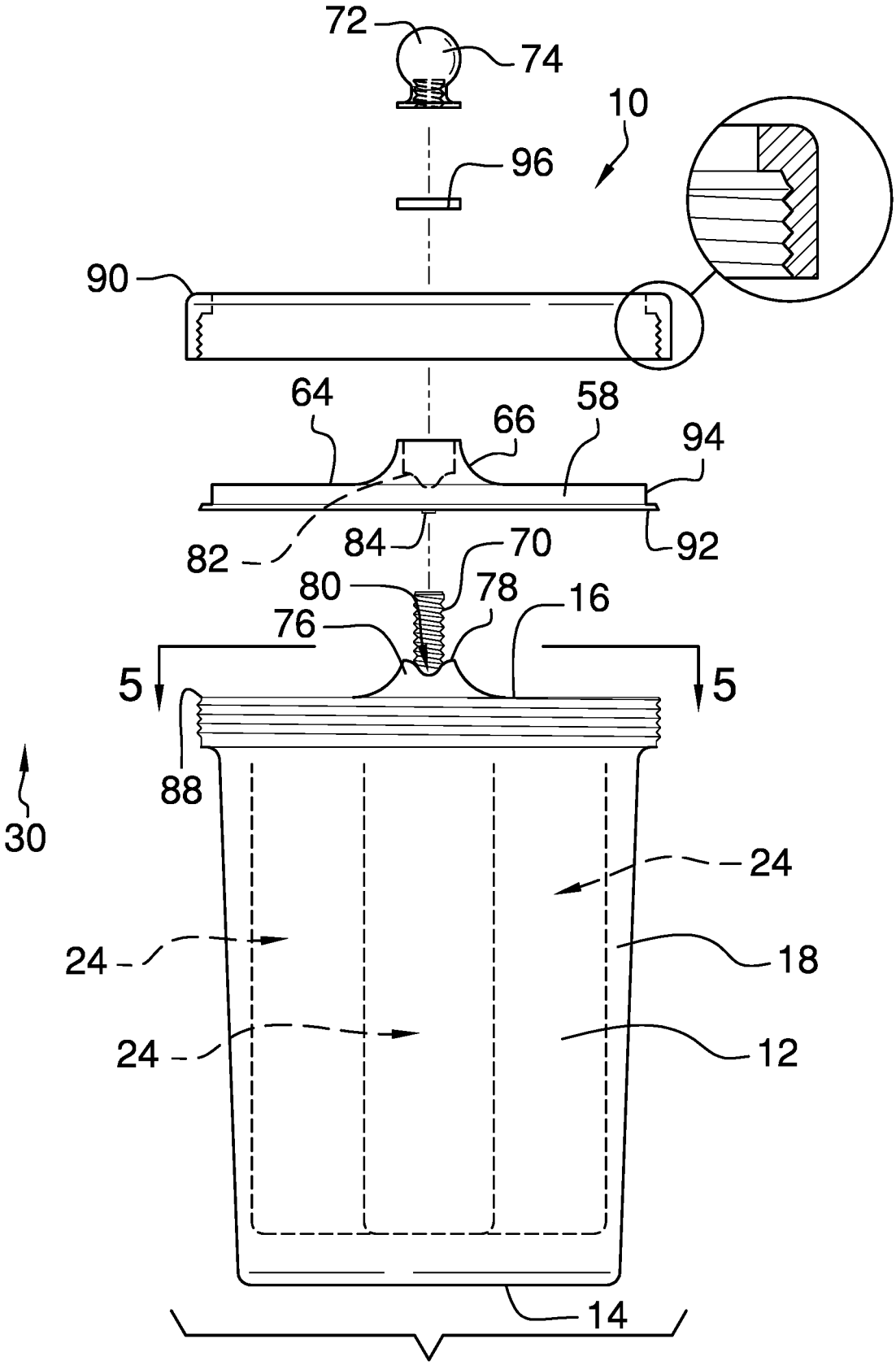
FIG. 4 is an exploded front view of an embodiment of the disclosure.
Figure 5:
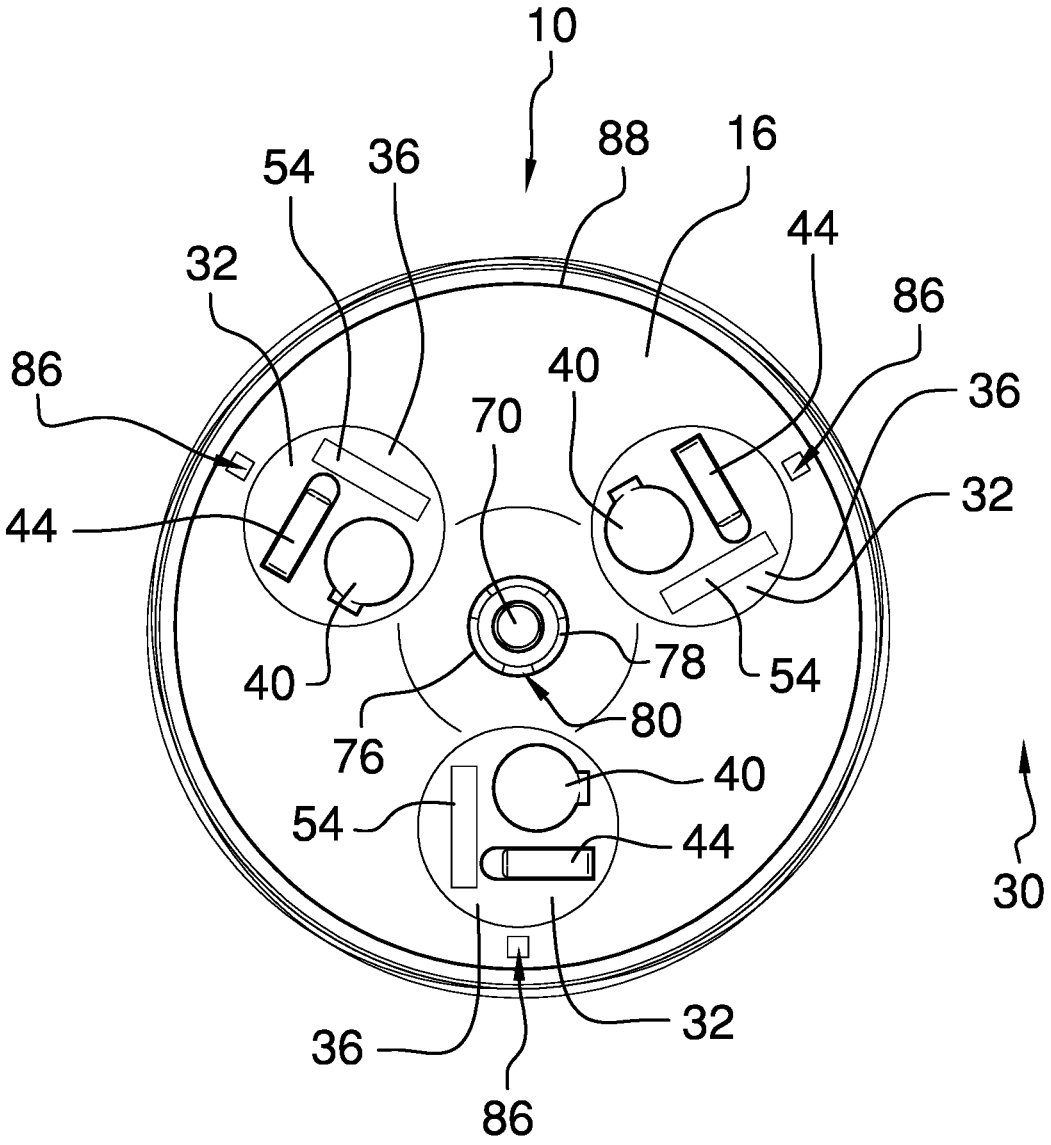
FIG. 5 is a detail top view of an embodiment of the disclosure without the lid from Arrows 5-5 in FIG. 4.
Figure 6:
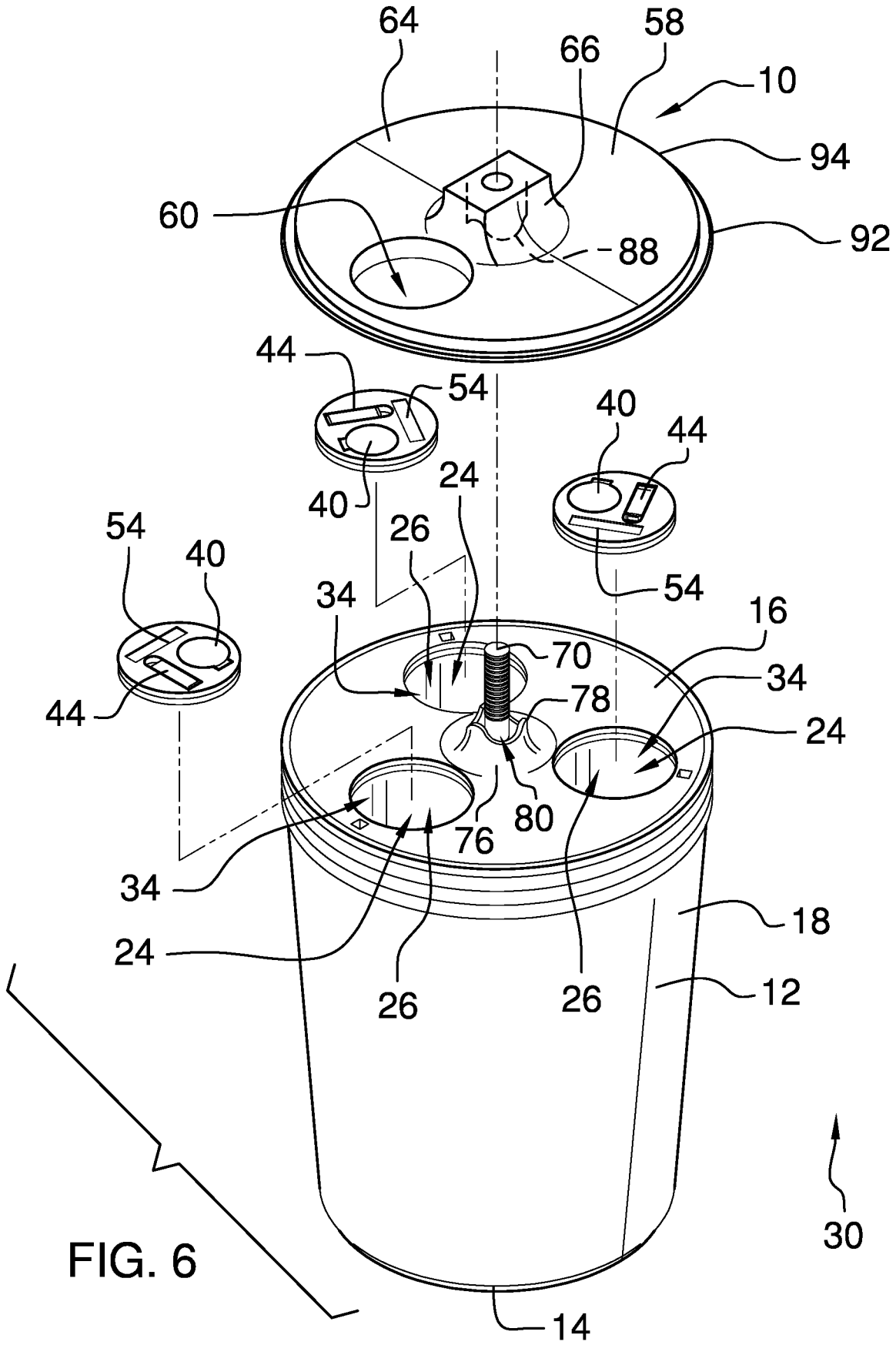
FIG. 6 is an exploded top front perspective view of an embodiment of the disclosure.
Figure 7:
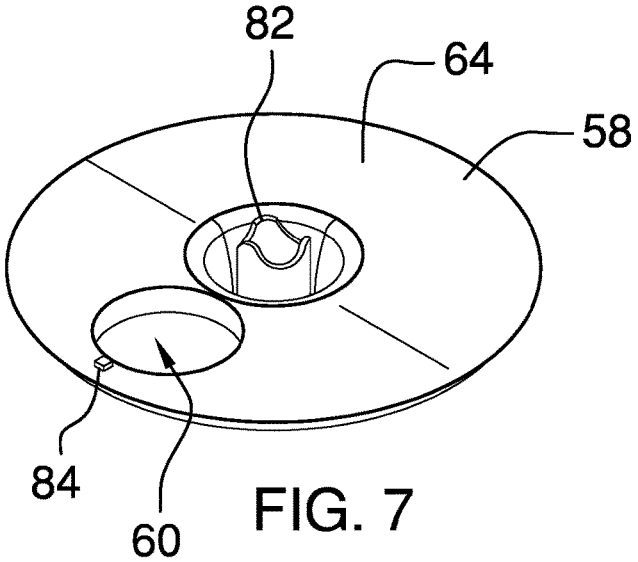
FIG. 7 is a detail bottom perspective view of the lid of an embodiment of the disclosure.
Figure 8A:
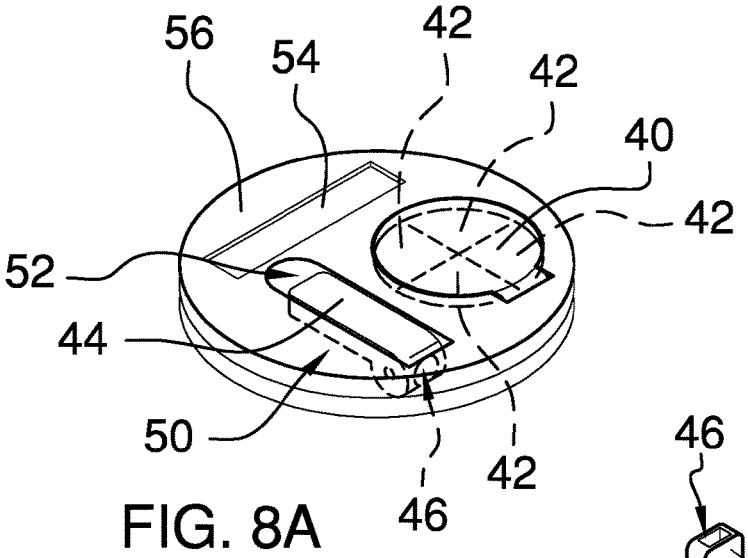
FIG. 8A is a detail top perspective view of a cap of an embodiment of the disclosure.
Figure 8B:
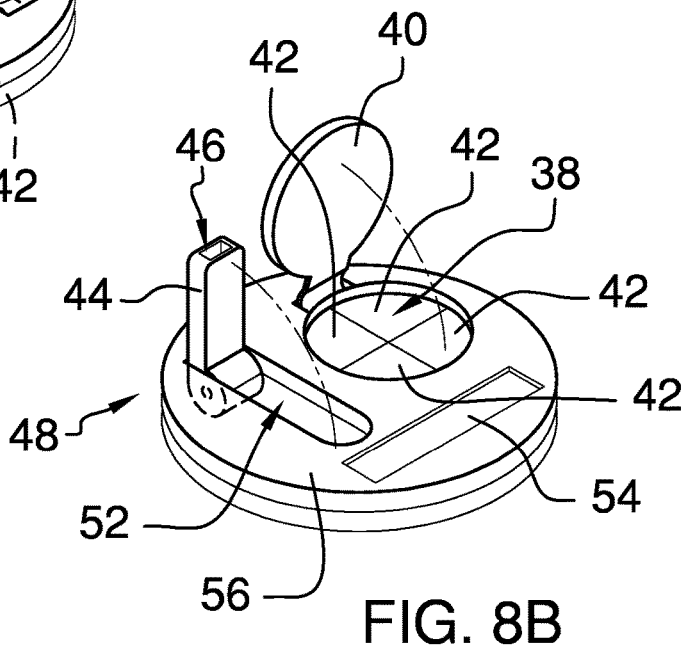
FIG. 8B is a detail top perspective view of a cap of an embodiment of the disclosure.

With reference now to the drawings, and in particular to FIGS. 1 through 8B thereof, a new drinking vessel embodying the principles and concepts of an embodiment of the disclosure and generally designated by the reference numeral 10 will be described.

As best illustrated in FIGS. 1 through 8B, the drinking vessel assembly 10 generally comprises a container 12 comprising a base wall 14, a top wall 16, and a sidewall 18 being coupled to and extending between the base wall 14 and the top wall 16. The container 12 includes a plurality of divider walls 20 each of which is coupled to and extends between the base wall 14 and the top wall 16. Each of the plurality of divider walls 20 is coupled to and extends inwardly from the sidewall 18, terminating in a junction 22 of the plurality of divider walls 20. The plurality of divider walls 20 form a plurality of compartments 24 in the container 12 that are discrete from each other. Each compartment 24 is configured for containing a fluid. The top wall 16 has a plurality of top holes 26 extending therethrough, and each compartment 24 is in fluid communication with one of the top holes 26. The container 12 may also have an interior space that is positioned within the base wall 14, sidewall 18, and each of the plurality of divider walls 20 and which is configured to be sealed from an external atmosphere 30. The interior space may be evacuated of air to form a vacuum that impedes heat transfer between the sidewall 18 and each of the plurality of compartments 24. Or the interior space may contain an insulating material that impedes the heat transfer between the sidewall 18 and each of the plurality of compartments 24.

Each of a plurality of caps 32 is coupled to the container 12, and each of the compartments 24 has a top end 34 which is closed by one of the caps 32. Each of the plurality of caps 32 comprises a disc member 36 is threadably coupled to the container 12, a straw hole 38 extending through the disc member 36, and a straw cover 40 being pivotably coupled to the disc member 36 to cover and expose the straw hole 38. Each cap 32 also comprises a plurality of flaps 42 coupled to the disc member 36 and extending into a center of the straw hole 38. Each of the plurality of flaps 42 is resiliently flexible and is configured to retain a drinking straw in the straw hole 38 when the drinking straw is inserted into the straw hole 38. Each cap 32 also comprises a tube 44 that is pivotably coupled to the disc member 36. The tube 44 is hollow and has a pair of apertures 46 extending therein. The tube 44 is movable between an open position 48 is in fluid communication with an associated one of the compartments 24 or in a closed position 50. The open position 48 includes the tube 44 extending upwardly from the disc member 36, and the closed position 50 includes the tube 44 being positioned in a groove 52 in the disc member 36. Each cap 32 may also comprise indicia identifying the fluid contained within the compartment 24 associated with the cap. The indicia may include numbers, letters, symbols, images, or the like. The indicia may be imprinted on a label which is removably adhered to an indented surface 54 in a top side 56 of the cap.

A lid 58 is rotatably coupled to the top wall 16 of the container 12 and has an opening 60 extending vertically through the lid 58. The lid 58 is positionable in each of a plurality of selection positions 62 to position the opening 60 over a selected one of the plurality of caps 32 such that the lid 58 covers all except the selected one of the plurality of caps 32. The lid 58 comprises a panel 64 and a grip 66. The opening 60 extends through the panel 64, and the grip 66 is centrally positioned on the panel 64.

A locking assembly 68 is coupled to the container 12 and engages the lid 58 to urge the lid 58 toward one of the plurality of selection positions 62. The locking assembly 68 may comprise a detent, a latch, a retaining pin, or the like to secure the lid 58 in each of the plurality of selection positions 62. In one embodiment, the locking assembly 68 comprises a rod 70 being coupled to and extending upwardly from the top wall 16 of the container 12. The rod 70 extending through the lid 58 along the rotational axis of the lid 58 such that the lid 58 is rotatable around the rod 70. A retainer 72 is coupled to the rod 70 and is positioned above the lid 58. The retainer 72 is threadably coupled to the rod 70 and may comprise a lock nut 74. An end cam 76 is coupled to and extends upwardly from the top wall 16 of the container 12 in the one embodiment. The end cam 76 has an upper surface 78 extending around the rod 70 which is contoured to form a plurality of notches 80 extending toward the container 12. A follower 82 is coupled to and extends downwardly from the lid 58 such that the follower 82 engages the upper surface 78 of the end cam 76. The lid 58 is positioned in one of the plurality of selection positions 62 when the follower 82 is positioned in one of the notches 80.

The one embodiment also comprises a spring-biased member 96 that is positioned around the rod 70 and between the retainer 72 and the lid 58. The spring-biased member 96 urges the follower 82 downward into one of the plurality of notches 80 such that the lid 58 is secured in the selection position 62 associated with the selected one of the plurality of notches 80. The spring-biased member 96 may be constructed of a resiliently compressible material such as rubber, nylon, silicone or the like. The spring-biased member 96 may also be a wave disc spring, a conical spring washer, or the like. The locking assembly 68 may also comprise a peg 84 that is coupled to and extends downwardly from the lid 58. The peg 84 is received into one of a plurality of recesses 86 extending into the top wall 16 of the container 12 when the lid 58 is in one of the plurality of selection positions 62 to further secure the lid 58 in one of the plurality of selection positions 62. Each of the plurality of recesses 86 is positioned between an outer edge 88 of the top wall 16 and one of the plurality of compartments 24.

A collar 90 for retaining the lid 58 adjacent to the container 12 is coupled to the container 12. The lid 58 has a flange portion 92 that is coupled to a peripheral edge 94 of the panel 64 and extending away from the rotational axis of the lid 58. The collar 90 extends around and above the flange portion 92 to retain the lid 58 adjacent to the container 12. The collar 90 may be threadably coupled to the container 12.

In use, the fluid is poured into one or more of the compartments 24. Each compartment 24 may contain a different fluid including, for example, different beverages for use at different stages of physical exercise. To access a compartment 24, the lid 58 is positioned in one of the selection positions 62 to expose one of the caps 32 through the opening 60. The cap 32 can be removed, a drinking straw can be inserted through the straw hole 38, or the spout can be pivoted upwardly to access the fluid contained within the compartment 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drinking vessel assembly comprising:

a container comprising a base wall, a top wall, and a sidewall being coupled to and extending between the base wall and the top wall, the container including a plurality of divider walls each of which is coupled to and extends between the base wall and the top wall, each of the plurality of divider walls being coupled to and extending inwardly from the sidewall and terminating in a junction of the plurality of divider walls, the plurality of divider walls forming a plurality of compartments in the container being discrete from each other and each being configured for containing a fluid, the top wall having a plurality of top holes extending therethrough and wherein each compartment is in fluid communication with a respective one of the top holes;

a plurality of caps each being coupled to the container, each of the compartments having a top end being closed by a respective one of the caps;

a lid being rotatably coupled to the top wall of the container, the lid having an opening extending vertically through the lid, the lid being positionable in each of a plurality of selection positions wherein the opening is positioned over a selected one of the plurality of caps such that the lid covers all except the selected one of the plurality of caps; and a locking assembly for securing the lid in one of the plurality of selection positions, the locking assembly being coupled to the container and engaging the lid to urge the lid toward one of the plurality of selection positions.

2. The assembly of claim 1, wherein the container has an interior space being positioned within the base wall, sidewall, and each of the plurality of divider walls, the interior space being configured to be sealed from an external atmosphere.

3. The assembly of claim 2, wherein the interior space is a vacuum, the interior space impeding heat transfer between the sidewall and each of the plurality of compartments.

4. The assembly of claim 2, further comprising an insulating material being contained within the interior space, the insulating material impeding heat transfer between the sidewall and each of the plurality of compartments.

5. The assembly of claim 1, wherein each of the plurality of caps comprises a disc member being threadably coupled to the container.

6. The assembly of claim 5, wherein each of the plurality of caps further comprises a straw hole extending through the disc member and a straw cover being pivotably coupled to the disc member, the straw cover being pivotable to cover and expose the straw hole.

7. The assembly of claim 6, wherein each of the plurality of caps further comprises a plurality of flaps being coupled to the disc member and extending into a center of the straw hole, each of the plurality of flaps being resiliently flexible, the plurality of flaps being configured to retain a drinking straw in the straw hole when the drinking straw is inserted into the straw hole.

8. The assembly of claim 5, wherein each of the plurality of caps further comprises a tube being pivotably coupled to the disc member, the tube being hollow and having a pair of openings extending therein, the tube being movable between an open position being in fluid communication with an associated one of the compartments or in a closed position, the open position including the tube extending upwardly from the disc member, the closed position including the tube being positioned in a groove in the disc member.

9. The assembly of claim 1, wherein the lid comprises a panel and a grip, the opening extending through the panel, the grip being centrally positioned on the panel.

10. The assembly of claim 9, further comprising a collar for retaining the lid adjacent to the container.

11. The assembly of claim 10, wherein the lid has a flange portion being coupled to a peripheral edge of the panel and extending away from the rotational axis of the lid, the collar being releasably coupled to the container, the collar extending around and above the flange portion, thereby retaining the lid adjacent to the container.

12. The assembly of claim 10, wherein the collar is threadably coupled to the container.

13. The assembly of claim 1, wherein the locking assembly comprises:

a rod being coupled to and extending upwardly from the top wall of the container, the rod extending through the lid along the rotational axis of the lid, wherein the lid is rotatable around the rod;

a retainer being coupled to the rod, the retainer being positioned above the lid, the retainer being threadably coupled to the rod;

an end cam being coupled to and extending upwardly from the top wall of the container, the end cam having an upper surface extending around the rod, the upper surface being contoured to form a plurality of notches extending toward the container;

a follower being coupled to and extending downwardly from the lid, the follower engaging the upper surface of the end cam, the lid being positioned in one of the plurality of selection positions when the follower is positioned in one of the notches; and a spring-biased member being positioned around the rod and between the retainer and the lid, the spring-biased member urging the follower downward into one of the plurality of notches such that the lid is secured in the selection position associated with the selected one of the plurality of notches.

14. The assembly of claim 13, wherein the spring-biased member is constructed of a resiliently compressible material.

15. The assembly of claim 13, wherein the locking assembly further comprises a peg being coupled to and extending downwardly from the lid, the top wall of the container having a plurality of recesses extending therein for receiving the peg therein, each of the plurality of recesses being positioned between an outer edge of the top wall and one of the plurality of compartments, the peg being received into one of the plurality of recesses when the lid is in one of the plurality of selection positions, thereby further securing the lid in one of the plurality of selection positions.

16. A drinking vessel assembly comprising:

a container comprising a base wall, a top wall, and a sidewall being coupled to and extending between the base wall and the top wall, the container including a plurality of divider walls each of which is coupled to and extends between the base wall and the top wall, each of the plurality of divider walls being coupled to and extending inwardly from the sidewall and terminating in a junction of the plurality of divider walls, the plurality of divider walls forming a plurality of compartments in the container being discrete from each other and each being configured for containing a fluid, the top wall having a plurality of top holes extending therethrough and wherein each compartment is in fluid communication with a respective one of the top holes, the container having an interior space being positioned within the base wall, sidewall, and each of the plurality of divider walls, the interior space being configured to be sealed from an external atmosphere, the interior space being a vacuum, the interior space impeding heat transfer between the sidewall and each of the plurality of compartments;

a plurality of caps each being releasably coupled to the container, each of the compartments having a top end being closed by a respective one of the caps, each of the plurality of caps comprising:

a disc member being threadably coupled to the container;

a straw hole extending through the disc member;

a plurality of flaps being coupled to the disc member and extending into a center of the straw hole, each of the plurality of flaps being resiliently flexible, the plurality of flaps being configured to retain a drinking straw in the straw hole when the drinking straw is inserted into the straw hole;

a straw cover being pivotably coupled to the disc member, the straw cover being pivotable to cover and expose the straw hole; and a tube being pivotably coupled to the disc member, the tube being hollow and having a pair of apertures extending therein, the tube being movable between an open position being in fluid communication with an associated one of the compartments or in a closed position, the open position including the tube extending upwardly from the disc member, the closed position including the tube being positioned in a groove in the disc member;

a lid being rotatably coupled to the top wall of the container, the lid having an opening extending vertically through the lid, the lid being positionable in each of a plurality of selection positions wherein the opening is positioned over a selected one of the plurality of caps such that the lid covers all except the selected one of the plurality of caps, the lid comprising a panel and a grip, the opening extending through the panel, the grip being centrally positioned on the panel;

a locking assembly for securing the lid in one of the plurality of selection positions, the locking assembly comprising:

a rod being coupled to and extending upwardly from the top wall of the container, the rod extending through the lid along the rotational axis of the lid, wherein the lid is rotatable around the rod;

a retainer being coupled to the rod, the retainer being positioned above the lid, the retainer being threadably coupled to the rod;

an end cam being coupled to and extending upwardly from the top wall of the container, the end cam having an upper surface extending around the rod, the upper surface being contoured to form a plurality of notches extending toward the container;

a follower being coupled to and extending downwardly from the lid, the follower engaging the upper surface of the end cam, the lid being positioned in one of the plurality of selection positions when the follower is positioned in one of the notches;

a spring-biased member being positioned around the rod and between the retainer and the lid, the spring-biased member urging the follower downward into one of the plurality of notches such that the lid is secured in the selection position associated with the selected one of the plurality of notches, the spring-biased member being constructed of a resiliently compressible material; and a peg being coupled to and extending downwardly from the lid, the top wall of the container having a plurality of recesses extending therein for receiving the peg therein, each of the plurality of recesses being positioned between an outer edge of the top wall and one of the plurality of compartments, the peg being received into one of the plurality of recesses when the lid is in one of the plurality of selection positions, thereby further securing the lid in one of the plurality of selection positions; and a collar for retaining the lid adjacent to the container, the lid having a flange portion being coupled to a peripheral edge of the panel and extending away from the rotational axis of the lid, the collar being releasably coupled to the container, the collar extending around and above the flange portion, thereby retaining the lid adjacent to the container, the collar being threadably coupled to the container.

* * * * *